US005324037A

United States Patent [19]

Greeson

[11] Patent Number: 5,324,037

[45] Date of Patent: Jun. 28, 1994

[54] MOBIUS STRIP PUZZLE

[76] Inventor: Ewell E. Greeson, 3801 Marilyn Dr., Doraville, Ga. 30340

[21] Appl. No.: 80,306

[22] Filed: Jun. 24, 1993

[51] Int. Cl.[5] ..... A63F 9/08

[52] U.S. Cl. ..... 273/155; 273/157 R; 446/487

[58] Field of Search ..... 273/155, 153 R, 157 R, 273/159, 156; 446/487

[56] References Cited

U.S. PATENT DOCUMENTS

| | | | |
|---|---|---|---|
| 1,636,371 | 7/1927 | Kenney | 273/155 |
| 3,758,981 | 9/1973 | Hlasnicek et al. | 273/109 |
| 3,884,462 | 5/1975 | Rebajes | 272/57 |
| 3,916,559 | 11/1975 | Flowerday | 273/155 |
| 4,214,747 | 7/1980 | Rebajes | 472/57 |
| 4,219,958 | 9/1980 | Shulyak | 446/487 |
| 4,384,717 | 5/1983 | Morris | 273/156 |
| 4,919,427 | 4/1990 | Keidar et al. | 273/155 |
| 5,110,130 | 5/1992 | Aulicino | 273/155 |

*Primary Examiner*—Vincent Millin

*Assistant Examiner*—Steven B. Wong

*Attorney, Agent, or Firm*—Michael Drew

[57] ABSTRACT

A completed, solved game puzzle 10 is a mobius strip made of multiple columns 24 and rows 22 of blocks 20, or block-like pieces. Each block 20 has opposing display surfaces and opposing connecting surfaces which are orthogonal to the display surfaces. The connecting surfaces have mechanisms such as a corresponding peg 30 and aperture 32, respectively, for connecting one block 20 to another block 20. The display surfaces exhibit a color, alphabet 28, number or symbol. The unsolved puzzle is one or more bands of blocks connected by and pivotable about an axis 26 extending through the center of each block 20 parallel to the display and connecting surfaces. The solution to the puzzle may be words or phrases spelled by aligned letters of individual strips, or a predetermined pattern formed from aligned colors or symbols. To solve the puzzle, the blocks of each strip must be connected adjacent the blocks of another strip at appropriate locations.

9 Claims, 2 Drawing Sheets

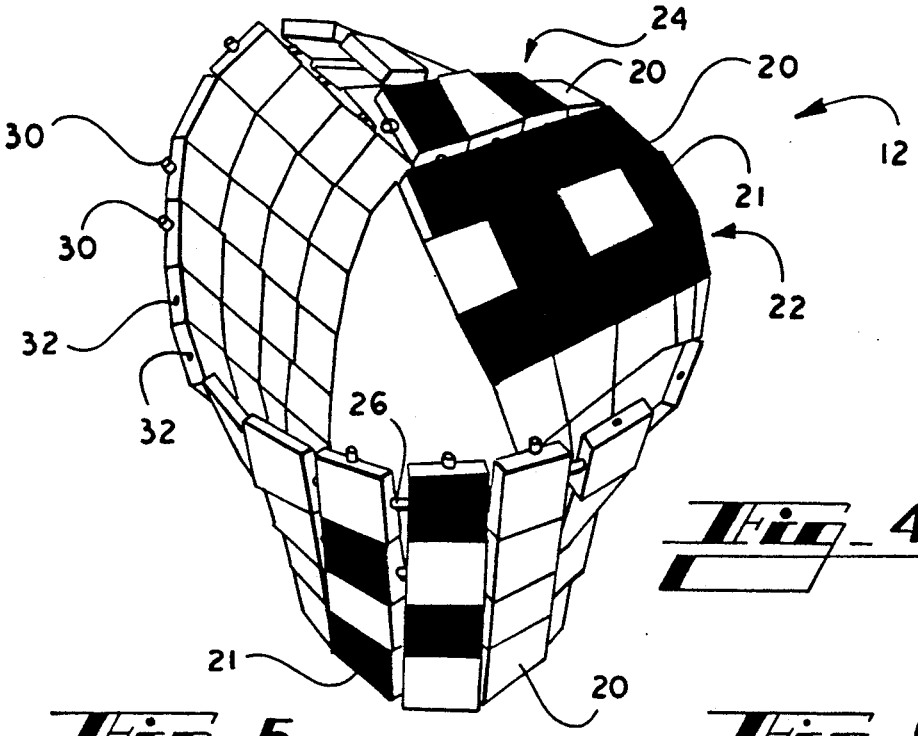
Fig. 4
Fig. 5
Fig. 6
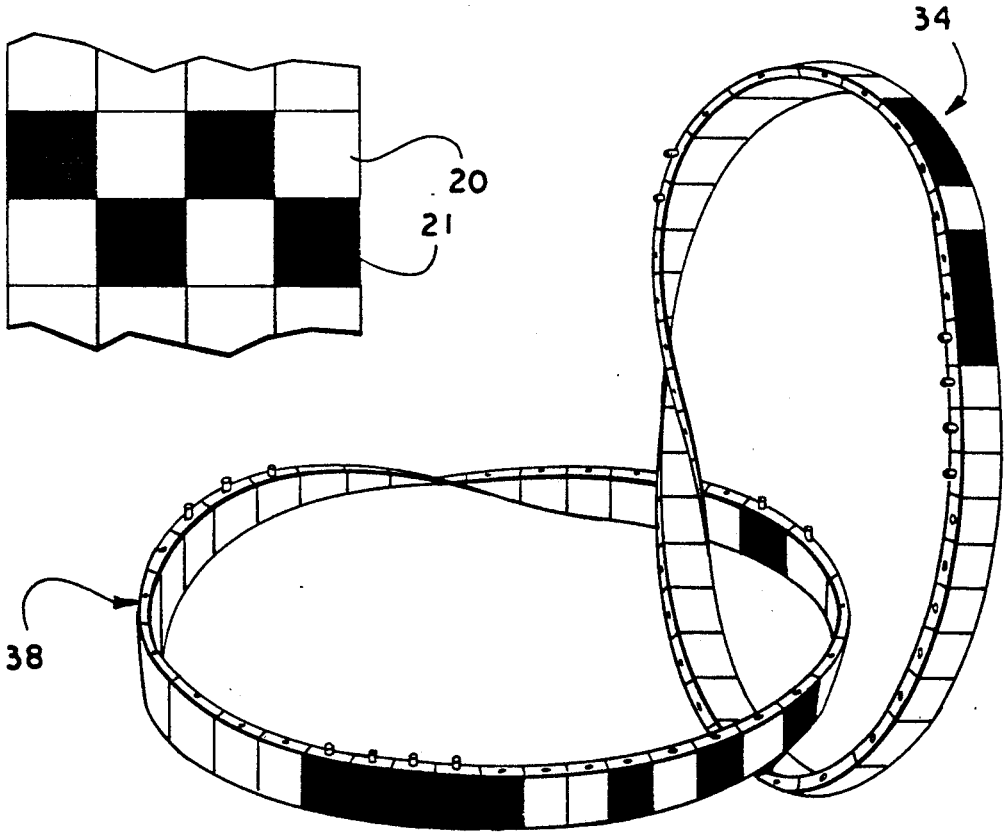

MOBIUS STRIP PUZZLE

TECHNICAL FIELD OF THE INVENTION

The invention relates to a game puzzle, and more particularly, to a game puzzle which when solved is a mobius strip displaying a pre-determined pattern.

BACKGROUND OF THE INVENTION

Game puzzles are entertaining as well as educational. The benefit derived from a game puzzle is in meeting the challenge of solving the puzzle. A mobius strip is a two-dimensional strip one end of which is twisted one-half turn and connected to the other end of the strip to form a ring. Although the original, un-joined strip has two distinct surfaces, the mobius strip has one continuous surface. It can be appreciated that a game puzzle incorporating a mobius strip would be extremely challenging.

SUMMARY OF THE INVENTION

An object of the invention is to provide a challenging game puzzle.

According to a preferred embodiment of the invention, a completed, solved game puzzle is a mobius strip has multiple columns and rows of blocks, or block-like pieces. Each block has opposing display surfaces and opposing connecting surfaces which are orthogonal to the display surfaces. The connecting surfaces have mechanism such as a corresponding prong and aperture, respectively, for connecting one block to another block. The display surfaces exhibit a color, alphabet, number or symbol. The unsolved puzzle is one or more bands of blocks connected by and pivotable about an axis extending through the center of each block parallel to the display and connecting surfaces. The solution to the puzzle may be words or phrases spelled by aligned letters of individual strips, or a predetermined pattern formed from aligned colors or symbols. To solve the puzzle, blocks of each strip must be connected adjacent blocks on the same or a different strip at appropriate locations.

Other aspects, objects, features, and advantages of the present invention will become apparent to those skilled in the art upon reading the detailed description of preferred embodiments.

BRIEF DESCRIPTION OF THE DRAWINGS

FIG. 4 is an isometric illustration of a four-column mobius strip puzzle according to another preferred embodiment of the present invention.

FIG. 5 is a plan view of a portion of the face of the invention of FIG. 4.

FIG. 6 is an isometric illustration of the invention of FIG. 4 with the individual bands which form the completed, solved puzzle unattached but interlocked.

DETAILED DESCRIPTION OF PREFERRED EMBODIMENTS OF THE INVENTION

While the specification concludes with claims particularly pointing out and distinctly claiming the subject matter which is regarded as the present invention, the invention will now be described with reference to the following description of embodiments taken in conjunction with the accompanying drawings. The same numerals are used to refer to like features throughout the drawings.

A completed and solved mobius strip puzzle according to preferred embodiments of the invention is a composite mobius strip whose components are parallel individual mobius strips. A mobius strip is a geometric figure formed from a double-faced strip which has one end twisted and attached to the other end. The resulting figure is a ring with a twist having one continuous face. To solve the puzzle according to the preferred embodiments of the invention, individual mobius bands must be twisted and otherwise manipulated, aligned and joined to create the composite mobius strip displaying a predetermined arrangements of words and phrases, or pattern.

Figure 1:
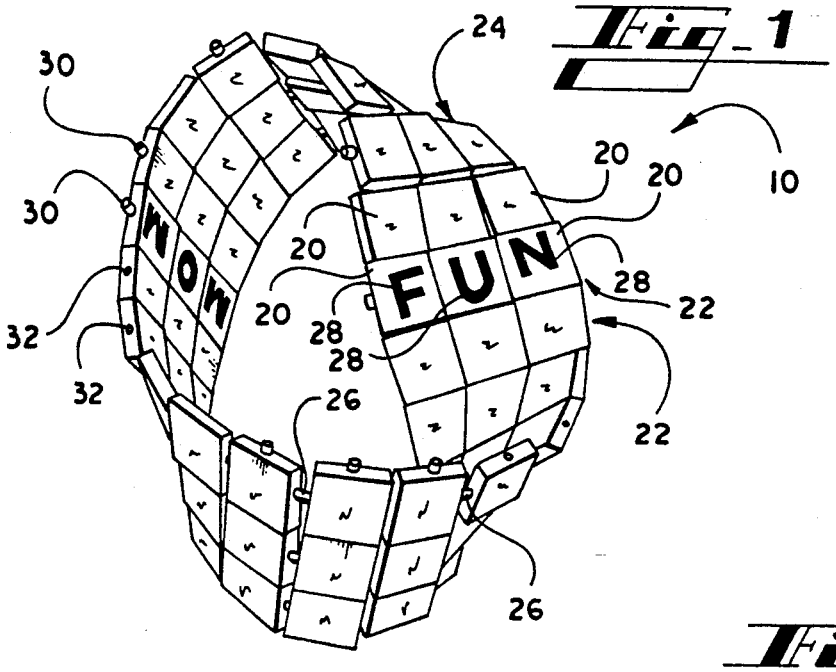
FIG. 1 is an isometric illustration of a three-column mobius strip puzzle according to a preferred embodiment of the invention.

Referring first to FIG. 1, therein is illustrated a mobius strip puzzle 10 according to a preferred embodiment of the invention. The puzzle 10 is shown in its completed, solved configuration. The composite mobius strip 10 consists of blocks 20 joined in a matrix of rows 22 and columns 24. In the preferred embodiment of FIG. 1, there are three parallel columns 24 and several rows 22. As will be discussed further below, the number of columns 24 in particular is variable and helps determine the complexity of the puzzle. The puzzle may consist of as few as two columns or as many as four or five, or even more.

Figure 2:
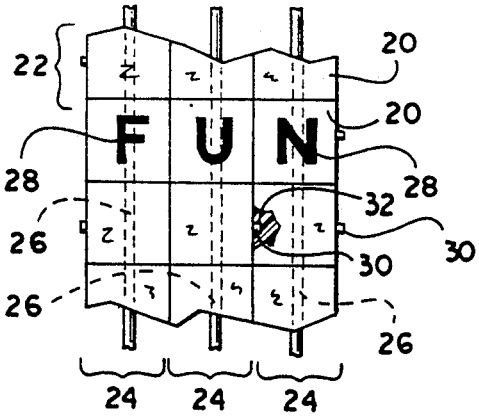
FIG. 2 is plan view of a portion of a face of the invention of FIG. 1.

In the preferred embodiment of FIG. 1, the rows 24 of blocks 20 are held together by and each block 20 is pivotal about a strand 26 extending through each block 20. The solved puzzle may display a predetermined pattern of colors, alphabets, numbers or symbols, or a combination thereof. The blocks 20 of the puzzle 10 in FIG. 1 display alphabets. The predetermined pattern which is sought in solving the puzzle 10 illustrated in FIG. 1 is a continuous band of horizontal words. The blocks 20 are interconnected through an arrangement of connecting pegs 30 and corresponding apertures 32. The pegs 30 and apertures 32 are sized to snugly fit together so as to lock when joined but be releasable when blocks 20 are pulled apart. Referring now also to FIG. 2, the alignment and cooperation of the features described above are shown from a different view. FIG. 2 clearly illustrates the alignment of the rows 22 and columns 24 of blocks 20, connecting strands 26, alphabets 28, and connecting peg 30 and aperture 32. In FIG. 2, a partial cutaway view of one of the blocks 20 shows the manner in which a peg 30 from one block 20 interconnects with the aperture 32 of a joined adjacent block 20.

Figure 3:
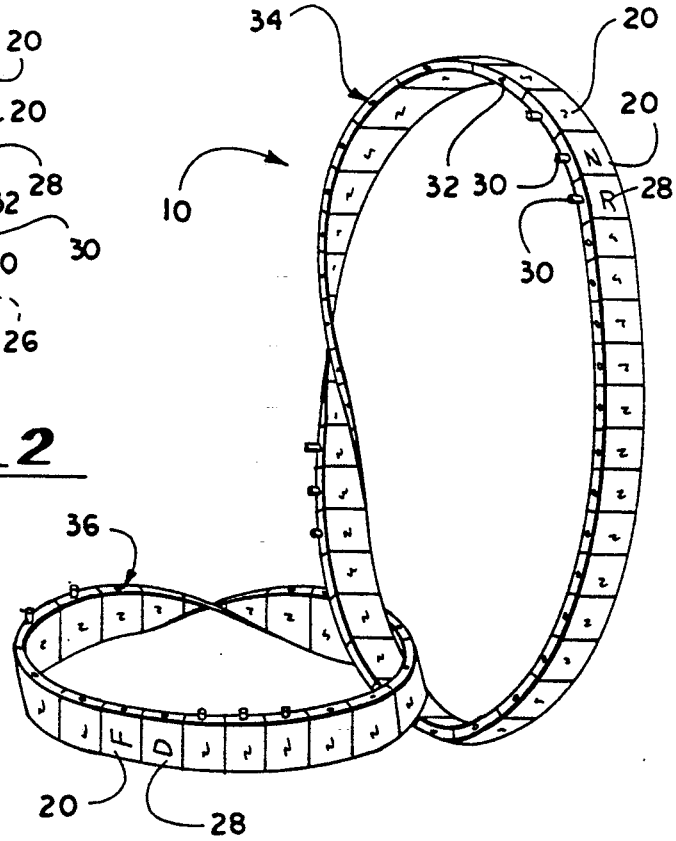
FIG. 3 is an isometric illustration of the invention of FIG. 1 with the individual bands which form the completed, solved puzzle unattached but interlocked.

Now, the disassembled, unsolved configuration of the puzzle 10 will be discussed. Referring now to FIG. 3, therein is shown the unassembled, unsolved puzzle 10 of FIG. 1. FIG. 3 illustrates two continuous bands 34, 36 of blocks 20 looped one through the other. The first band 34 is made up of a number N of blocks 20. The second band 36 is made up of a number of blocks 20 totaling one-half of the number N of blocks 20 of the first band 34. The key to solving the puzzle 10 is to connect blocks 20 from the first band 34 and second band 36 to create the mobius strip of FIG. 1. One of the challenges of the puzzle 10 is to connect the blocks 20 of the two bands 34, 36 such that the mobius strip of FIG. 1 if formed. A second challenge is to form the mobius strip such that the surfaces, or surface, of the mobius strip puzzle 10 display a predetermined pattern. As previously mentioned, the predetermined pattern of FIG. 1 is a series of rows of a words spelled out by the alphabets 28 of the blocks 20. It is also possible to have the columns 24 of blocks 20 spell-out words. Although the puzzle 10 may be configured to have several possible solutions, it will always at least one solution. When there is only one solution, each block 20 of the first band 34 must be connected to one specific block 20 of the second band 36. The challenge of the puzzle 10 is made even greater because the blocks 20, as previously described, are rotatable about a strand, or other device, which interconnects the blocks 20 of each band 34, 36. Each side of a block 20 may display a different color, alphabet, number or symbol. The challenge of solving the puzzle is thus increased because not only must the correct blocks 20 of each band 34, 36 be interconnected but the correct side of each block also. For example, referring again momentarily to FIG. 1, the word "FUN" is shown as a part of the predetermined pattern of the solved puzzle 10. The block 20 containing the letter "F" displays a different letter on the opposing side of the block so that the rear surface of that row 22 of blocks also displays a word.

The preferred embodiment of the invention illustrated in FIG. 1 is a puzzle 10 having three columns of blocks in the solved mobius strip. The unsolved configuration of this 3-column puzzle 10 is the two bands 34, 36 described above, namely, a first band 34 containing N blocks and a second band 36 containing ½N blocks 20. The puzzles which may be created from the invention may be solved to form a mobius strip of two or more columns depending upon how many continuous bands of blocks 20 are initially used. The starting, unsolved configuration of the puzzles of the invention will always have at least one band containing N number of blocks 20. For example, a solved puzzle which is a mobius strip of two columns of blocks 20 has an initial unsolved configuration of one continuous band of length N. The 3-column version of the puzzle 10 illustrated has an unsolved configuration of one band of length N and one band of length ½N. The number of columns in the solved puzzle increases in a direct geometric progression to the number of bands of blocks 20. The relationship between the number of columns of blocks 20 in the solved mobius strip puzzle and the number of bands of blocks of length N and the number of bands of blocks of length ½N can be described by the equation $C=2X+Y$, where C is the number of columns of blocks 20 in the solved mobius puzzle, X is the number of bands of blocks 20 of length N, and Y is the number of bands of blocks 20 of length ½N. As previously mentioned, there will always be at least one band of length N. X will always be an integer which is greater than or equal to one. The number of bands of blocks 20 which contain one-half of the number N of blocks 20 of at least one band length N will always be none or one. The relationship described by the above equation and the geometric progression discussed is illustrated in the following chart:

| Number of Columns of Blocks in Solved Mobius Strip Puzzle | Number of Bands Having N Blocks | Number of Bands Having 1/2N Blocks |
|---|---|---|
| 2 | 1 | 0 |
| 3 | 1 | 1 |
| 4 | 2 | 0 |
| 5 | 2 | 1 |
| 6 | 3 | 0 |

As is shown in the above chart, each additional column of blocks in the solved mobius strip puzzle requires an additional amount of blocks equal to ½N. Solved puzzles containing an even number of columns have no bands of length ½N. Solved puzzles having an odd number of columns have at least one band of length N and one band of length ½N blocks.

Referring once again to FIG. 3, each band 34, 36 is shown as having a twist to make the band 34, 36 itself a mobius strip. In a more simple version of the puzzle 10, the blocks 20 are not pivotable. In such an embodiment, each band of length ½N blocks is twisted and half turned into a mobius strip. Each band of length N is twisted two full turns. These twists enable the solved puzzle to be configured as a mobius strip.

Referring now to FIGS. 4, 5, and 6, therein are illustrated a 4-column puzzle 12. This puzzle 12 also illustrates blocks 20 displaying a solid color without indicia and blocks 21 of a second solid color without indicia, rather than blocks displaying alphabets 28 as illustrated in FIGS. 1-3. The same features described above are also illustrated in these drawings, namely rows 22 of blocks 20, 21, columns 24 of blocks 20, 21, and corresponding pegs 30 and apertures 32 for connecting the blocks 20, 21. As illustrated in FIGS. 4 and 5, the predetermined pattern of the solved puzzle 11 is a checkerboard-type pattern. Referring now particularly to FIG. 6, the two bands 34, 38 of identical length N which make up the 4-column puzzle are shown.

There are many possible variations for the elements of the invention. For example, the block-like members may have faces of a circular configuration rather than the square configuration illustrated. Another variation is that the connecting mechanism for the blocks 20 may be a tongue and groove type of arrangement rather than the peg 30 and aperture 32 shown. A challenging variation is for each block, rather than having a cube-like appearance with two opposing display surfaces and two opposing connecting surfaces having six or eight surfaces, or having surfaces that double as display and connecting surfaces. Another variation is for the blocks to be connectable by means of magnetic surfaces. An example of the color scheme illustrated by FIGS. 4, 5, and 6 is light and dark blocks 20. However, the color scheme may consist of a variety of colors that would fit together in a predetermined multi-colored pattern. An example of symbols which may be displayed is a variety of arrows pointing in different directions. The solved puzzle may even exhibit a composite picture where each block 20 is a piece of a puzzle.

As should be apparent from the foregoing specification, the invention is susceptible of being modified with various alterations and modifications which may differ from those which have been described in the preceding specification and description. Accordingly, the following claims are intended to cover all alterations and modifications which do not depart from the spirit and scope of the invention.

What is claimed is:

1. a puzzle comprising:

a first band of N block members adapted for twisting into a mobius strip, wherein N is a whole number greater than or equal to 1, each said block member having at least two surfaces parallel to an axis extending through a center of said block member adapted for displaying a color, an alphabet, a number or a symbol, each said block member having at least two opposing sides having mating means for connecting said side of one block member to said side of another block member so that said surface of one block member is co-planar with said surface of a connected block member; and at least one second band of said block members, having kN block members, wherein k is the fraction ½ or the whole number 1, and wherein when k is ½, N is an even number;

wherein the puzzle may be solved by connecting said block members of said first band to said block members of said second band to create a mobius strip displaying a pre-determined pattern of said colors, alphabets, numbers or symbols.

2. The invention of claim 1, wherein each said block member is pivotal about said axis extending through said center of said block member.

3. The invention of claim 1, said mating means comprising a peg extending from one said side of each said block and an opposing said side of each said block defining an aperture corresponding to and adapted for closely receiving said peg.

4. A puzzle comprising:

a first band of N cube-like members, wherein N is a whole number greater than or equal to 1, each said cube-like member having at least two opposing faces adapted for displaying a color, an alphabet, a number or a symbol, and having two opposing sides orthogonal to said two opposing faces having means for connecting said cube-like members to one another, said cube-like members connected by and pivotal about a first strand forming a loop extending through said cube-like members perpendicular to said opposing faces and opposing sides; and at least one second band of said cube-like members, having kN cube-like members, wherein k is the fraction ½ or the integer 1, and wherein when N is an even number k is ½, each said cube-like member pivotal about a second strand forming a loop extending through said cube-like members perpendicular to said opposing faces and opposing sides;

wherein the puzzle may be solved by connecting said cube-like members of said first band to said cube-like members of said second band to create a mobius strip having a number of columns of said cube-like members defined by the relationship $C=2X+Y$, where C is the number of columns, X is the total of said first band plus said second bands of length N, and Y is the number of said second bands of length ½N, and X is an integer greater than or equal to 1 and Y is either 0 or 1, said mobius strip displaying a pre-determined pattern of said colors, alphabets, numbers or symbols.

5. The invention of claim 4, said means for connecting said cube-like members to one another comprising a peg extending from one said opposing side of said cube-like member and an other said opposing side of said cube-like member defining an aperture corresponding to and adapted for receiving said peg.

6. The invention of claim 4, wherein said two opposing faces are adapted for displaying an alphabet and said predetermined pattern of said colors, alphabets, numbers or symbols comprise predetermined words formed from said alphabets.

7. The invention of claim 4, wherein said two opposing faces are adapted for displaying one of two colors and said predetermined pattern of said colors, alphabets or symbols comprises a predetermined pattern of numbers.

8. The invention of claim 4, wherein X is 1 and Y is 1.

9. The invention of claim 4, wherein X is 2 and Y is 0.

* * * * *